US006148500A

United States Patent [19]

Krone et al.

[11] Patent Number: 6,148,500

[45] Date of Patent: Nov. 21, 2000

[54] ELECTRONIC INDUCTIVE DEVICE AND METHOD FOR MANUFACTURING

[75] Inventors: Kenneth P. Krone; John F. Trites, both of San Diego, Calif.

[73] Assignee: Autosplice Systems Inc., San Diego, Calif.

[21] Appl. No.: 08/924,898

[22] Filed: Sep. 8, 1997

Related U.S. Application Data

[62] Division of application No. 08/505,955, Jul. 24, 1995, Pat. No. 5,781,091.

[51] Int. Cl.[7] ..... H01F 7/06

[52] U.S. Cl. ..... 29/602.1; 29/608; 29/852; 336/200

[58] Field of Search ..... 29/602.1, 603.01, 29/603.13, 605, 606, 841, 825, 852, 855; 336/200, 323, 83

[56] References Cited

U.S. PATENT DOCUMENTS

| | | | |
|---|---|---|---|
| 2,388,737 | 11/1945 | Gotha | 29/155.5 |
| 3,185,947 | 5/1965 | Freymodsson | 336/200 |
| 3,290,758 | 12/1966 | Moyer | 29/155.5 |
| 3,413,716 | 12/1968 | Schwertz et al. | 29/602 |
| 3,431,144 | 3/1969 | Yawata et al. | 117/212 |
| 3,881,244 | 5/1975 | Kendall | 29/602 X |
| 4,522,671 | 6/1985 | Griinwald et al. | 156/235 X |
| 5,048,747 | 9/1991 | Clark et al. | 228/180.2 X |
| 5,226,220 | 7/1993 | Gevas et al. | 29/605 X |
| 5,299,754 | 4/1994 | Lackowski | 242/197 |
| 5,425,166 | 6/1995 | Hastings et al. | 29/602.1 X |
| 5,425,167 | 6/1995 | Shiga et al. | 29/606 X |
| 5,430,613 | 7/1995 | Hastings et al. | 361/760 X |
| 5,461,353 | 10/1995 | Eberhardt | 333/246 X |
| 5,521,573 | 5/1996 | Inoh et al. | 336/180 X |
| 5,532,667 | 7/1996 | Haertling et al. | 336/177 X |
| 5,572,180 | 11/1996 | Huang et al. | 336/200 X |
| 5,576,680 | 11/1996 | Ling | 336/200 |
| 5,583,474 | 12/1996 | Mizoguchi et al. | 336/83 X |
| 5,619,791 | 4/1997 | Lambrecht, Jr. et al. | 29/852 X |
| 5,652,561 | 7/1997 | Inoh et al. | 336/200 X |
| 5,745,981 | 5/1998 | Roshen et al. | 29/607 X |
| 5,761,791 | 6/1998 | Bando | 29/609 X |
| 5,781,091 | 7/1998 | Krone et al. | 336/200 |
| 5,802,702 | 9/1998 | Fleming et al. | 29/608 X |

FOREIGN PATENT DOCUMENTS

| | | | |
|---|---|---|---|
| 59-103320 | 6/1984 | Japan | 29/602.1 |

*Primary Examiner*—Jessica J. Harrison
*Assistant Examiner*—Minh Trinh

[57] ABSTRACT

Inductive electrical components fabricated by PWB techniques of ferromagnetic core or cores are embedded in an insulating board provided with conductive layers. Conductive through-holes are provided in the board on opposite sides of a core. The conductive layers are patterned to form with the conductive through-holes one or more sets of conductive turns forming a winding or windings encircling the core. The conductive layers can also be patterned to form contact pads on the board and conductive traces connecting the pads to the windings.

10 Claims, 10 Drawing Sheets

ELECTRONIC INDUCTIVE DEVICE AND METHOD FOR MANUFACTURING

This application is a division of application Ser. No. 08/505,955, filed Jul. 24, 1995, now U.S. Pat. No. 5,781,091.

This invention relates to methods and devices for fabrication of ferromagnetic components such as inductors, chokes and transformers by printed wiring board (PWB) techniques.

BACKGROUND OF THE INVENTION

Inductive components, such as transformers, common-mode chokes, relays, and other magnetic coupled components or devices, employing toroidal ferromagnetic cores, are conventionally manufactured as discrete components as follows. The toroidal core is manually or automatically wound with insulated copper or magnet wire followed by encapsulation of the wound coil and solder termination of the coil's wire leads as required by the application circuit for which it is intended. The conventional technology's winding accounts for 50% of the labor costs, with solder termination and encapsulation processes requiring 40% and 10%, respectively. The total labor for the conventional technology represents about 65% of the total cost of goods sold. The resultant components' high frequency performance (i.e., leakage inductance, distributed and inter-winding capacitances, and longitudinal balance) varies considerably due to difficulty in maintaining control over the placement of the magnetic wires.

SUMMARY OF THE INVENTION

An object of the invention is a ferromagnetic component fabrication technology that is capable of mass-production of high-performance inductor and transformer products at a lower cost compared to conventional fabricated products.

Another object of the invention is a ferromagnetic component fabrication technology providing more reliable or repeatable components with better control over its properties.

In accordance with one aspect of the present invention, inductive components are fabricated on a mass production basis using PWB techniques. In the inventive method, ferromagnetic cores are mounted in holes or embedded in substrates or carriers that are primarily electrically insulating and non-magnetic, but are covered with conductive layers on opposite major surfaces of the carrier.

Through-holes that are electrically conductive and serve as vias (a term of art meaning an electrically conductive hole forming an electrical interconnection between electrically conductive points at different levels or layers of an assembly) are provided on opposite sides of each ferromagnetic core to form the sides of a set of one or more turns forming a coil encircling the core. The tops and bottoms of the coil turns are formed by patterning the conductive layers.

In a preferred embodiment, the carrier is constituted by a sandwich of four PWB layers laminated together to form an assembly. Conductive traces on the inner PWB layers are used with vias to form a first coil encircling a toroidal ferromagnetic core, and conductive traces on the outer PWB layers are used with vias to form a second coil encircling the toroidal core and overlying the first coil.

A major benefit of this method for manufacturing inductive components is eliminating manual intensive processes including core winding, encapsulation, and solder terminations. This reduction in manual labor greatly reduces manufacturing cost not only by reducing the amount of labor required but also by reducing the cost of labor since a lower skill level is needed to implement the technology of the invention.

Another important benefit is tighter control of high frequency parameters of the resultant components because of tighter fabrication tolerances. For example, it is possible with standard PWB technology to place all vias and conductive traces with 1 mil of optimum position.

These and other objects and attainments together with a fuller understanding of the invention will become apparent and appreciated by referring to the following descriptions and claims taken in conjunction with the accompanying drawings which illustrate by way of example and not limitation preferred embodiments of the invention and wherein like reference numerals denote like or corresponding parts.

DETAILED DESCRIPTION OF THE PREFERRED EMBODIMENTS

There will now be described in detail as an example the fabrication of transformers with tapped primary and secondary windings in accordance with the invention.

For many applications, the components may be fabricated from ordinary insulated boards coated or otherwise covered with conductive layers, and with vias formed by stamping or machining. Moreover, inductive components can be fabricated with rod cores or toroidal cores, containing any desired number of wires, number of turns, winding methodology, such as bifilar, trifilar or quadfilar, configuration, such as no taps, single center-tap or dual center-taps, and various core geometries. However, an important feature of the invention is the ability to mass-produce at low cost micro-inductors, transformers and other inductive components of very small dimensions, for example, of 280 mils on a side with terminals spaced 100 mils apart. For this application, the drilled vias must not exceed 6 mils in diameter. For accurate placement of vias, ordinary drilling and stamping are not sufficiently accurate and thus the known technology of laser drilled holes is preferably used. For laser drilling, certain kinds of rigid PWB laminates are preferred. These generally include non-woven aramide types available commercially from suppliers such as DuPont under the names of "epoxy/E-glass" or "epoxy/thermount", and typically referred to in the art as C-stage laminate material typically 48–50 mils thick. Also of preferred use are so-called B-stage or pre-preg laminate materials.

The most important application of the invention is transformers with overlapping closely-coupled primary and secondary windings on toroidal cores.

Figure 1:
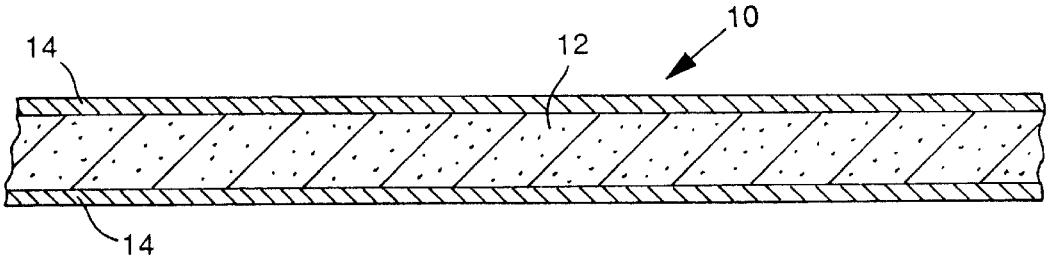
FIGS. 1–4 are schematic cross-sectional views of steps in the fabrication of one form of a transformer application which includes but is not limited to tapped windings in accordance with the invention.
Figure 2:
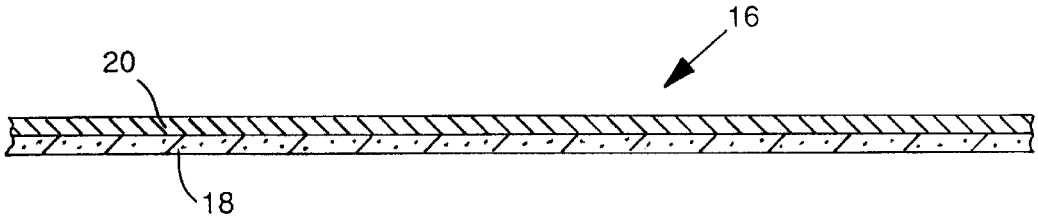
Figure 3:
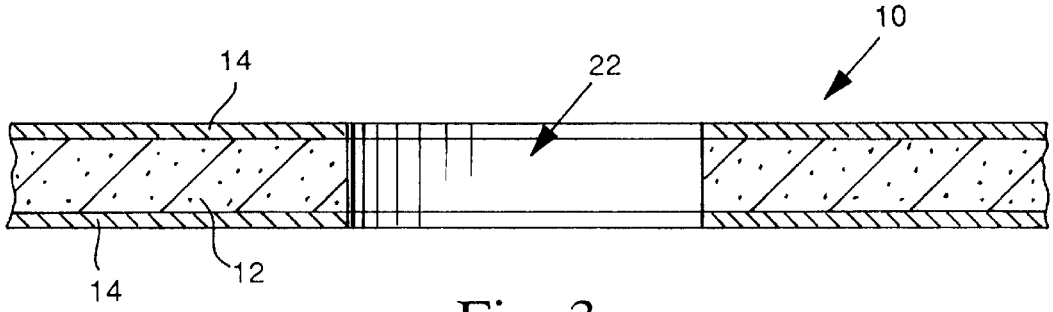
Figure 4:
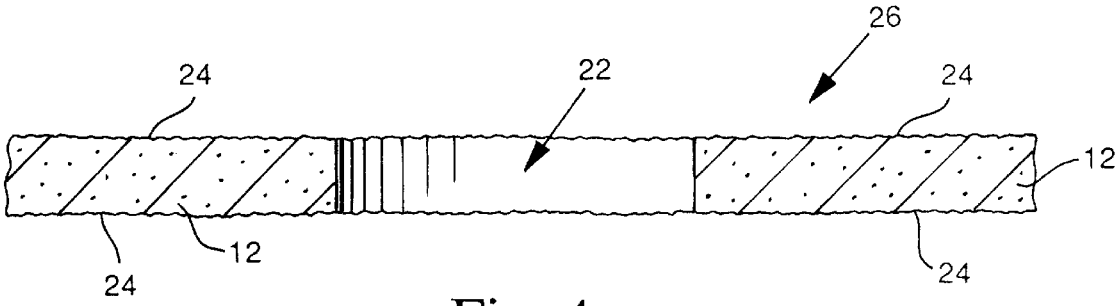

FIG. 1 shows a double-sided, copper-clad C-stage laminate 10 comprising a middle electrically insulating part 12 of several sheets of epoxy/E-glass or epoxy/thermount laminated to two 0.5 or 1.0 oz copper foil sheets 14. FIG. 2 illustrates a typical one-sided B-stage laminate 16 made up of one insulating layer 18 and one copper foil sheet 20. In FIG. 3, a pattern of spaced holes 22 is drilled in the C-stage laminate 10. In FIG. 4, the copper-cladding 14 has been etched off in its entirety leaving the insulating center 12 with roughened major surfaces 24, the resultant board now referenced 26. The roughened surfaces are desirable for the subsequent lamination steps to ensure good bonding. While it may be possible to start with insulating boards and directly roughen the surface, etching off of the copper cladding is a more reliable method of providing an insulating layer with roughened, laminatable-ready surfaces.

Figure 5:
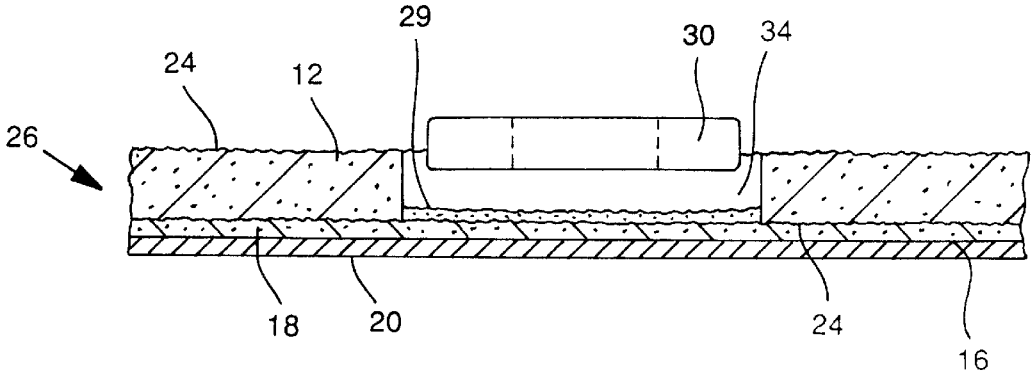
FIG. 5 is an exploded perspective view showing mounting of individual toroidal cores into a substrate or carrier.
Figure 6:
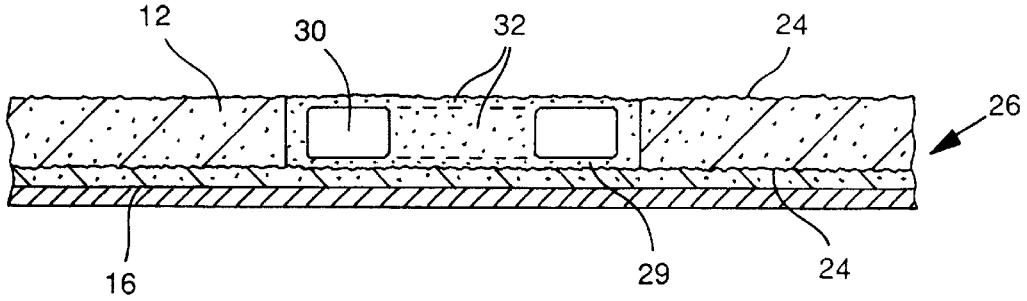
FIG. 6 is a schematic cross-sectional view of the carrier of FIG. 5 showing placement of one core.

FIG. 5 shows the beginning of the lamination process with the B-stage laminate 16 placed in the bottom of a conventional lamination press (not shown) and the drilled and etched C-stage laminate 26 on top. A thin layer of fiber filled epoxy, ground pre-preg or Kevlar pulp 29 is layered into the holes 22. Toroidal ferromagnetic cores 30 are installed in each of the core holes 22. FIG. 6 continues with adding another layer of fiber filled epoxy, pre-preg or Kevlar pulp 32 on top and in the center of toroids 30 completely covering the cores 30 and embedding the cores 30 in the insulating carrier 12.

Figure 7:
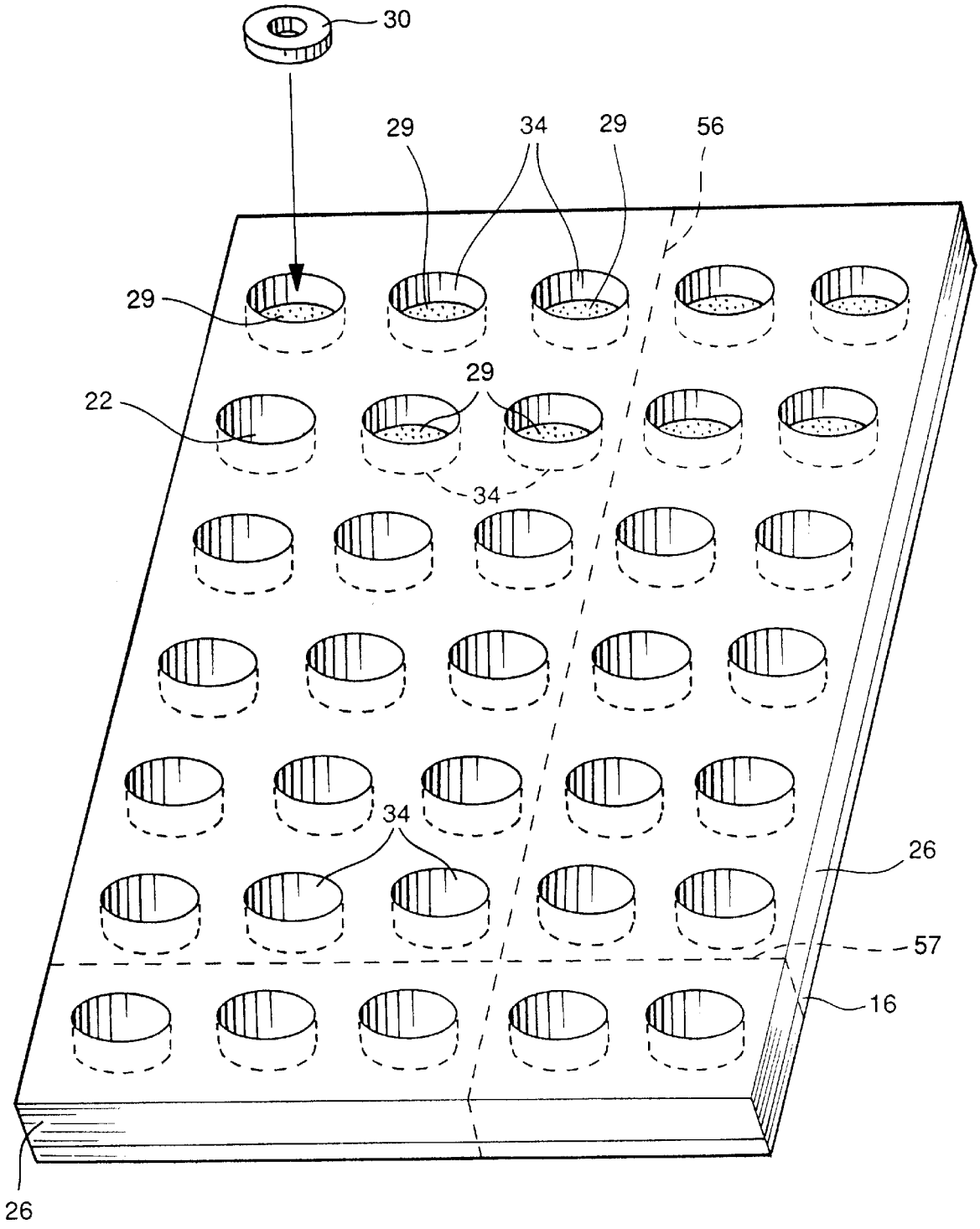
FIG. 7 is a perspective view of the carrier of FIG. 5.

FIG. 7 is a perspective view of the assembly of FIG. 6, containing multiple rows of multiple holes/row each containing a blind hole 34 formed by drilling 22 in the laminate 26 whose bottom is closed off by the laminate 16. Some of the holes 34 contain fiber filled epoxy ground pre-preg, or Kevlar insulating material 29 into which toroidal ferromagnetic cores 30 will be placed.

Figure 8:
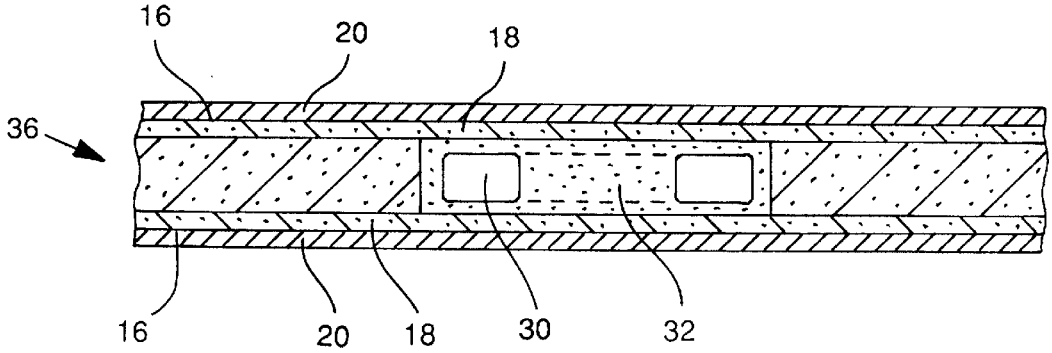
FIGS. 8–15 are schematic cross-sectional views of further steps in the fabrication of the transformer whose fabrication was begun in FIGS. 1–7.

FIG. 8 continues by adding a second single-sided copper clad B-stage ply 16 on top of the drilled and etched C-stage core 26. This inner-layer stack in FIG. 8, 36, is vacuum laminated, for example at 350–400° F. for about 90 minutes.

Figure 9:
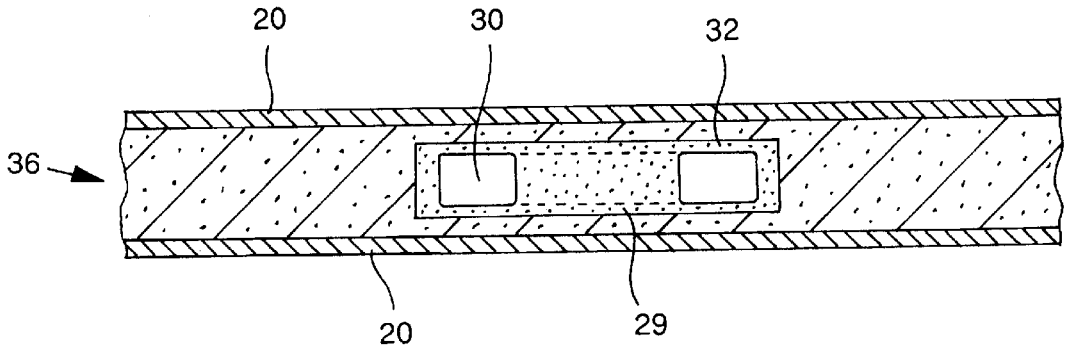

FIG. 9 shows the final laminated inner-layer panel 36 with the embedded toroidal cores 30 surrounded by fused fiber filled epoxy, ground pre-preg or Kevlar pulp 29, 32. The resultant laminated panel 36 comprises an insulating center ply covered at top and bottom with copper cladding 20.

The lamination step preferably takes place in vacuum or an inert atmosphere, such as nitrogen, to avoid damage to the ferromagnetic properties of the core materials. Preferably the cores are composed of maganese-zinc or nickel zinc soft high-permeability ferrites, available commercially. These materials can suffer degradation if heated at elevated temperatures in an oxidizing atmosphere.

Figure 10:
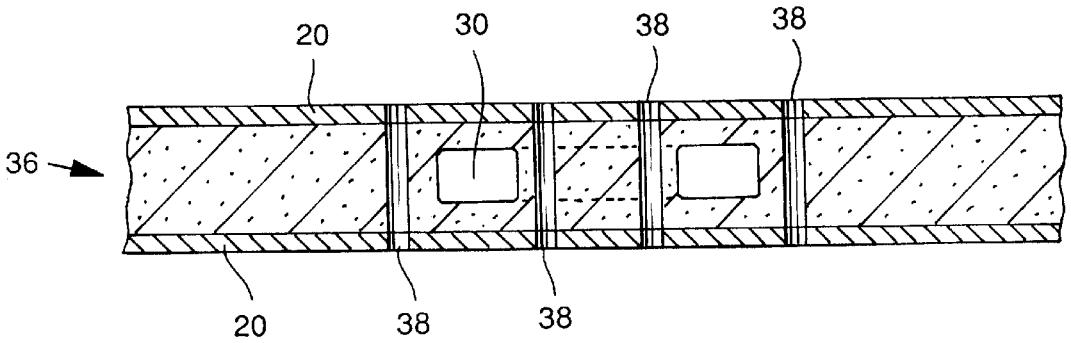

The process continues in FIG. 10 where the resultant panel 36 (hereinafter called from time-to-time the inner panel) with embedded cores 30 are laser-drilled to form sets of through-holes 28 on opposite sides of the core material to serve as inner layer micro-via holes 33. The holes will typically range in diameter from 3 to 20 mils. Laser drilling is preferred for micro-via holes because of its accuracy and speed.

Figure 11:
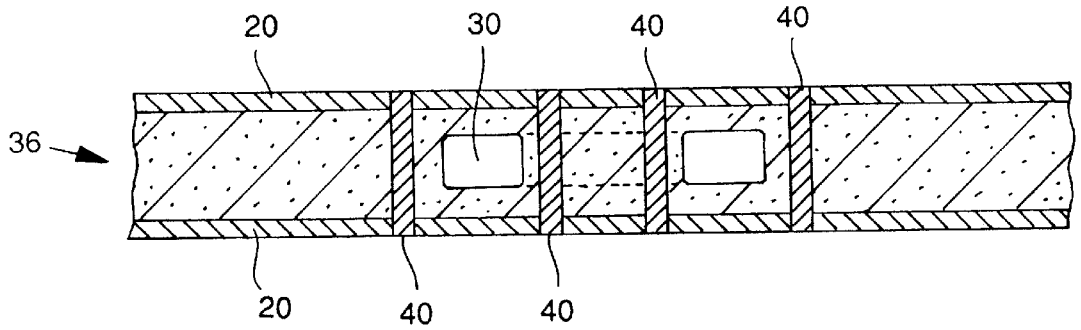
Figure 12:
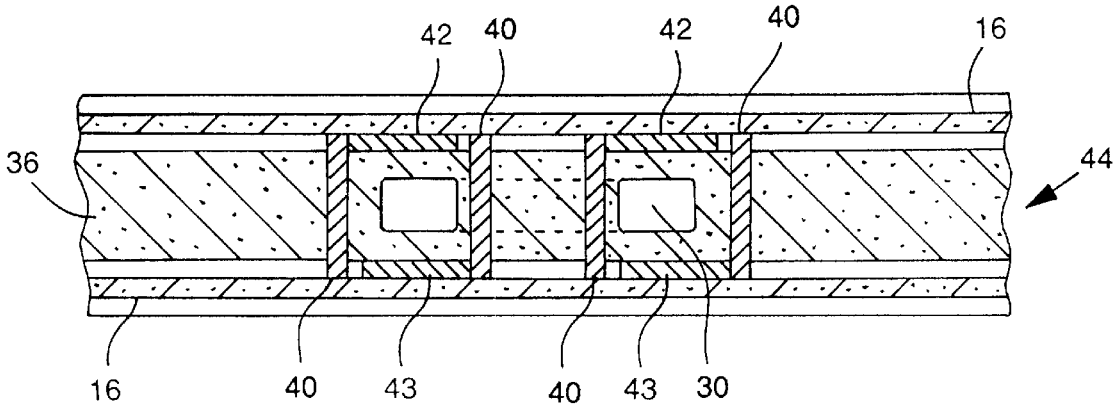

FIG. 11 shows the inner-layer micro-vias 38 after electroless plating in known manner. The micro-vias 38 are filled with copper and are now conductive micro-vias, referred to as 40. FIG. 12 is the result of two further process steps. First, the drilled and plated inner-layer 36 is sent through a conventional image, direct plating, electrolytic plating, and circuit etching process which creates the inner-layer primary circuit signal layers 42, 43. Next, a sandwich is formed comprised of a bottom B-stage panel 16, the etched, plated, and drilled inner-layer laminated panel 36, and a top B-stage panel 16, which is then vacuum laminated as previously described to create a laminated outer-layer panel 44.

Figure 16A:
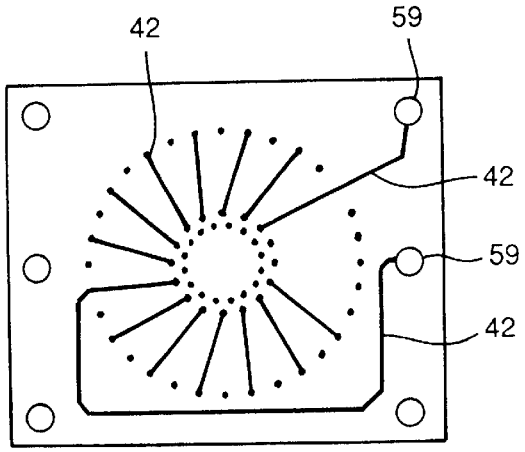
FIGS. 16A–16D illustrates the conductive trace pattern at the different levels of the transformer fabricated in FIGS. 1–15.
Figure 16B:
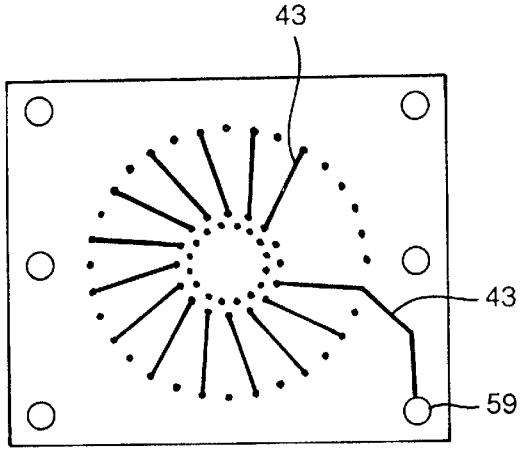

FIGS. 16A and 16B show a single unit view of the inner signal traces 42, 43 on top 60 and bottom 62, respectively, of the inner laminated board 44.

Figure 13:
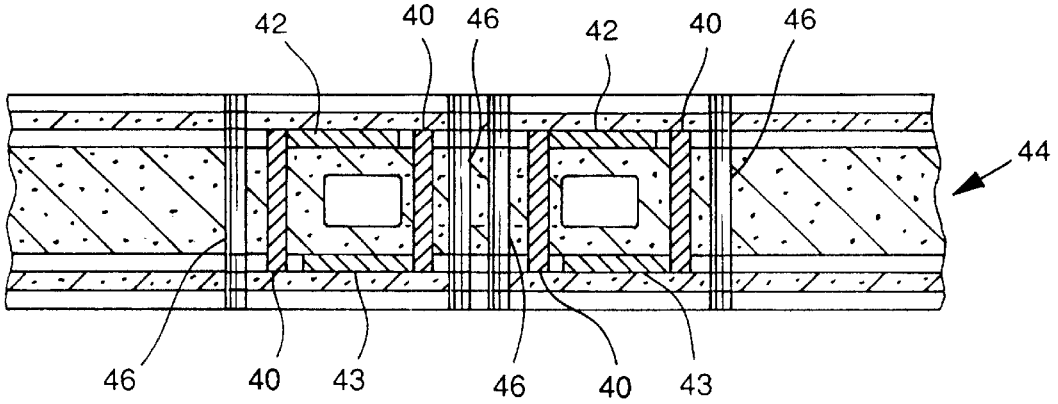
Figure 14:
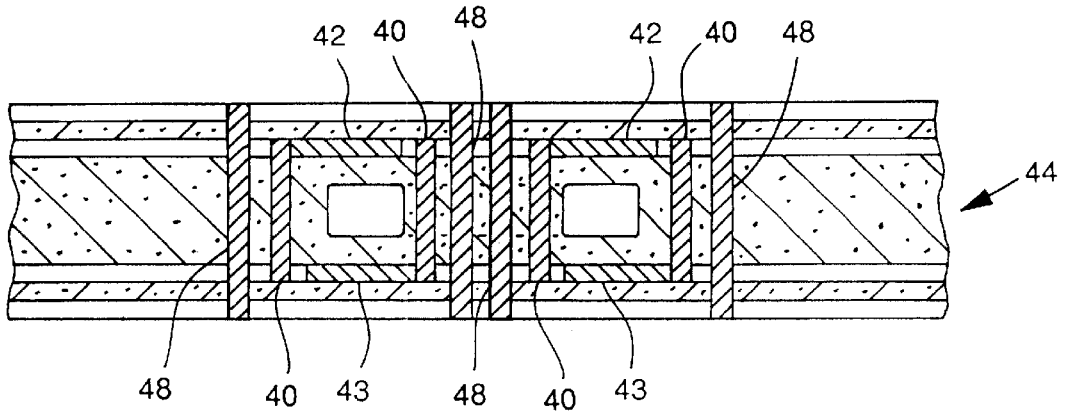

In FIG. 13, outer-layer micro-via holes 46 are laser drilled in the laminated outer-layer panel 44. FIG. 14 shows similar to FIG. 12, direct or electroless and electrolytic plated outer-layer micro-vias 40 in the drilled laminated outer-layer panel 44.

Figure 15:
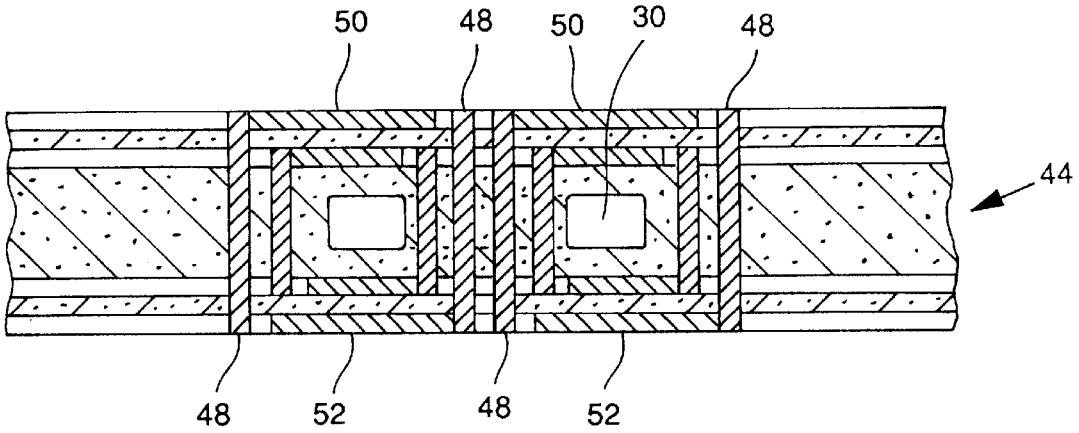

In FIG. 15, the micro-via drilled and plated outer-layer laminate 44 is sent through an electrolytic plating operation which creates the outer-layer secondary circuit signal layers 50, 52 to form a completed rigid PWB panel.

Figure 16C:
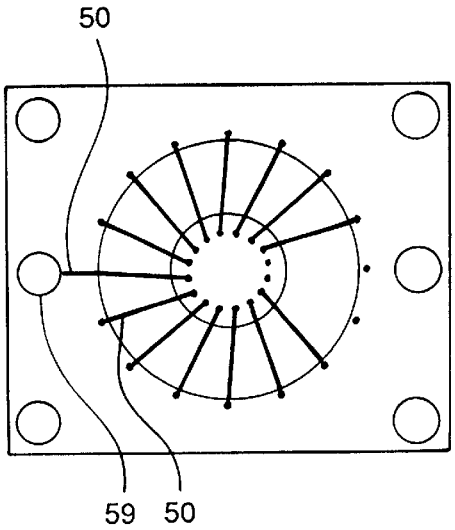
Figure 16D:
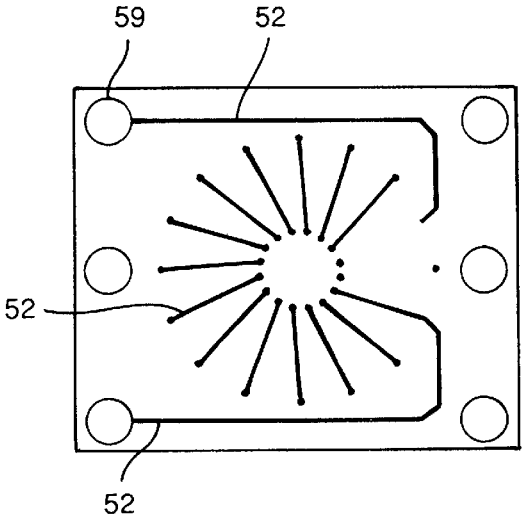

FIGS. 16C and 16D show a single unit view of the outer signal traces 50, 52 on the outermost top and bottom layers, respectively.

The resultant rigid PWB panel 44 is then sent through solder mark and V-scoring processes. The V-scoring process cuts horizontal and vertical V-score lines on both sides of the rigid PWB panel 44. FIG. 7 illustrates by dashed lines 56, 57 just two of the score lines. Vertical 56 and horizontal 57 score lines are made between each row and each column of embedded core units, outside of the contact pads indicated in FIGS. 16A–16D at 59. Individual units are then severed at the score lines. Each individual unit, indicated at 62 in FIG. 17, comprises an embedded core 30 with inner primary turns (not shown) represented by conductive traces 42, 43 and vias 40 over which are provided outer secondary turns represented by conductive traces 50, 52 and vias 48. Both primary and secondary windings encircle core 30.

Figure 17:
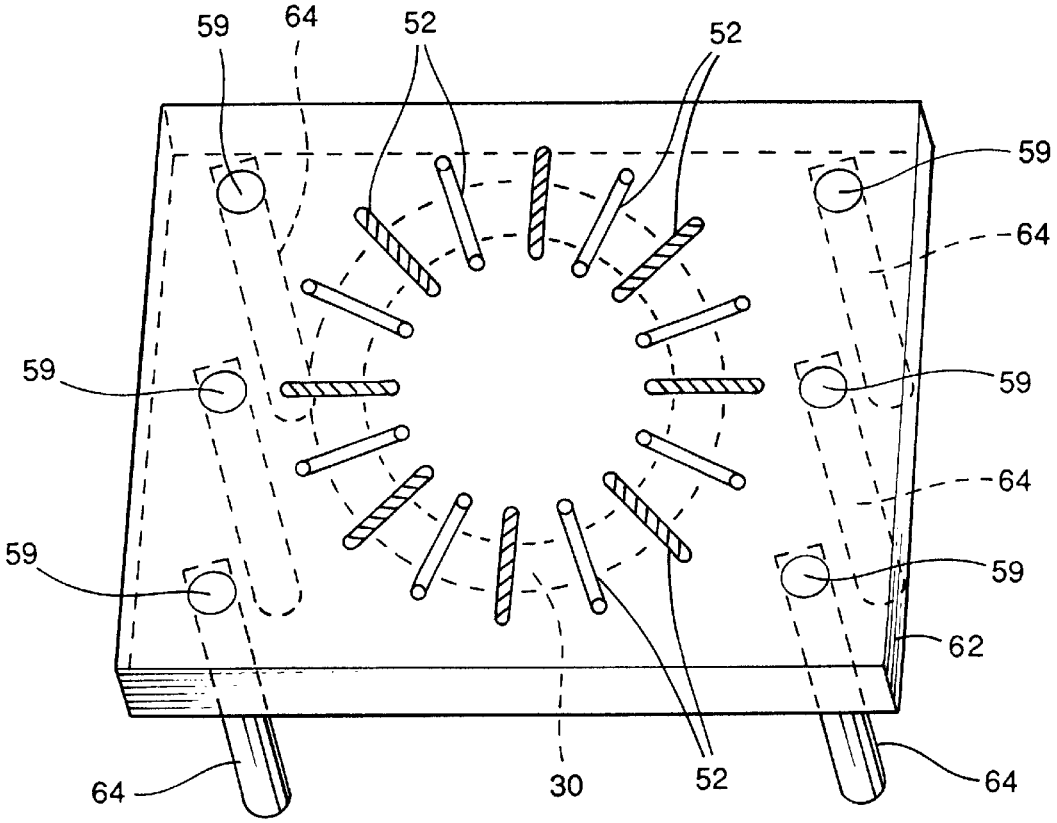
FIG. 17 is a perspective view of the finished transformer.

FIG. 17 shows one version of the component with pins 64 installed, while still in panel form, from the bottom side of the rigid PWB panel 44.

Figure 18:
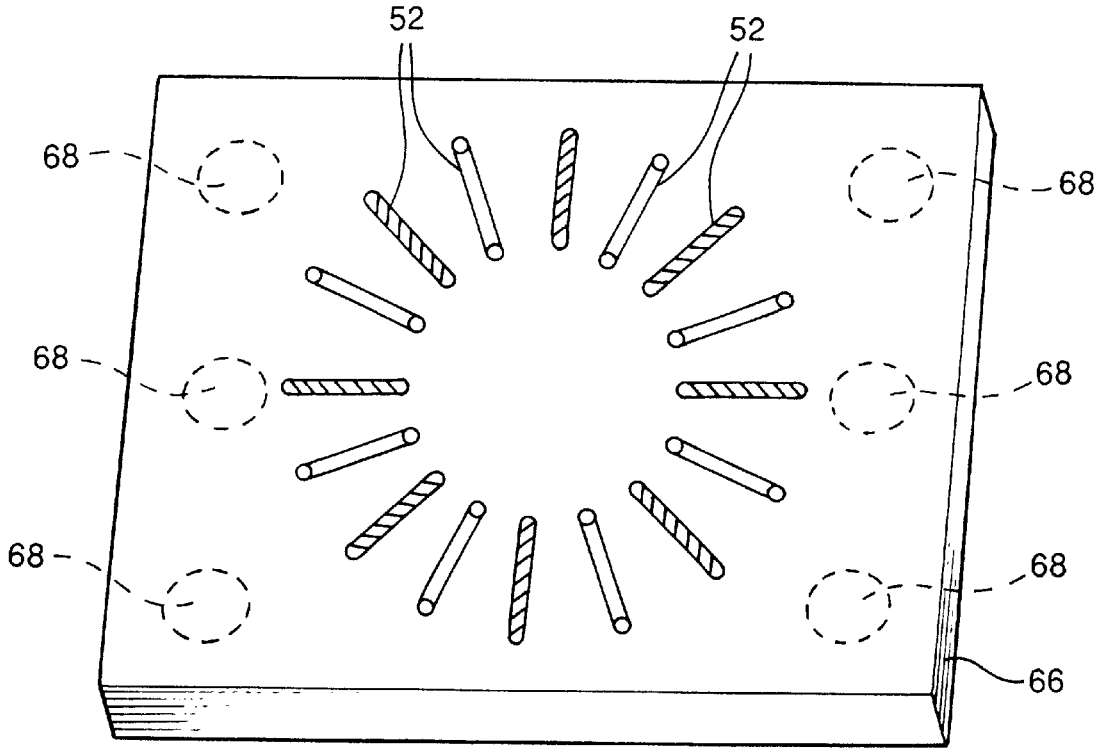
FIGS. 18 and 19 are perspective and side views, respectively, of a modification.
Figure 19:
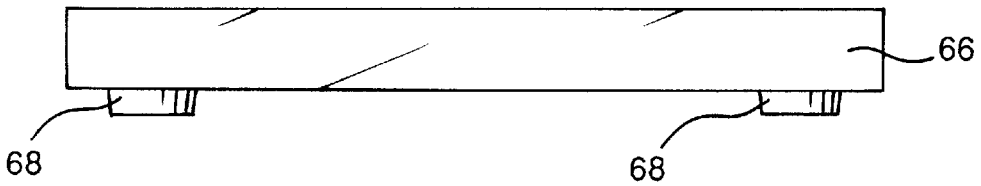

FIGS. 18 and 19 show a modified unit 66 with Ball Grid Array (BGA) solder bumps 68 installed, while still in panel form, on the bottom side of the rigid PWB panel 44.

As will be evident from FIGS. 16A–16D, the terminals in the right side connect to the inner primary winding, and the terminals on the left hand side connect to the outer secondary winding.

The preceding embodiments have described the manufacture of a plurality of inductive components simultaneously in a large-area PWB, from which individual units can be severed. The process of the invention is also applicable to the fabrication of single units, or of a plurality of interconnected single units to form a network of components.

Figure 20:
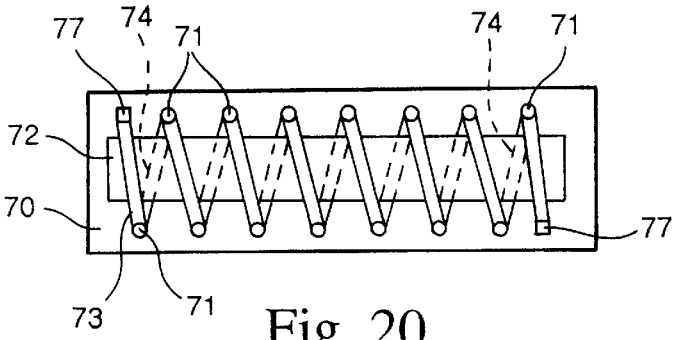
FIGS. 20–22 are schematic top and cross-sectional views, respective, of a single inductor device created from a ferromagnetic rod core embedded in a insulating carrier base with plated micro-vias, top and bottom layer plated signal traces, and I/O pads.

FIG. 20 shows a top view of a single inductor device comprises of top layer signal traces 73, bottom layer signal traces 74, plated micro-vias 71, a middle insulating base material 70, an embedded ferromagnetic rod core 72, and two I/O pads 77 at opposite ends of the assembly. In this embodiment, a single coil surrounds the rod-shaped core 72.

Figure 21:
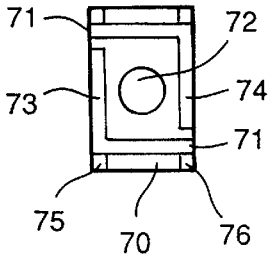
Figure 22:
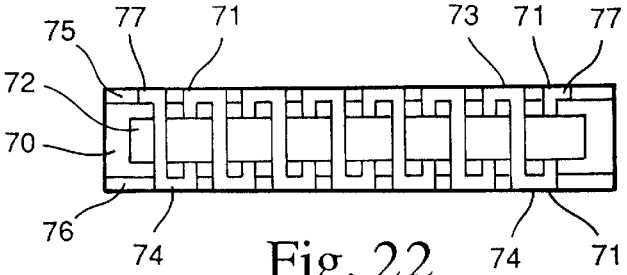

FIGS. 21 and 22 show cross-sectional views of the same single inductor device shown in FIG. 20, which includes a middle insulating base material 70, a top insulating layer 75, a bottom insulating layer 76, plated micro-vias 71, an embedded ferromagnetic rod core 72, top layer signal traces 73, bottom layer signal traces 74, and two I/O pads 77.

Figure 23:
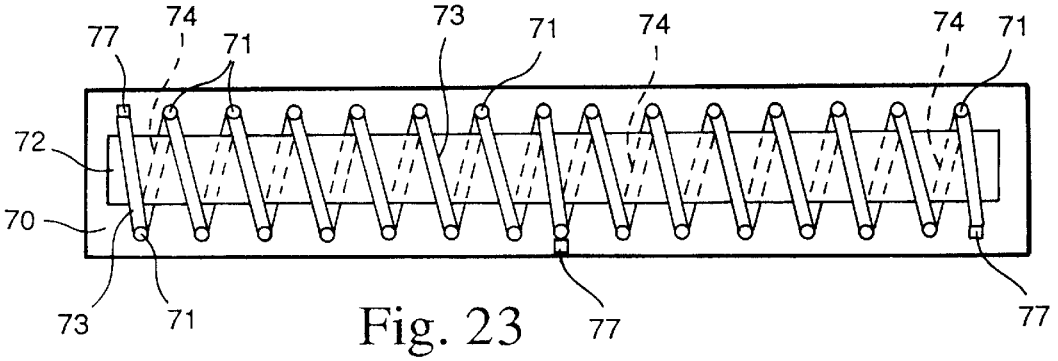
FIGS. 23 and 24 are schematic top and side views, respectively, of a dual inductor device with additional center-tapped I/O pad created in the same fashion as shown in the single inductor device of FIGS. 20–22.
Figure 24:
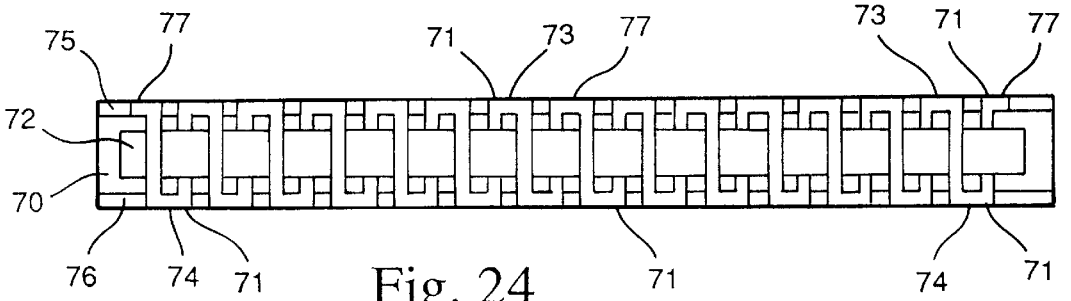

FIGS. 23 and 24 show top and cross-sectional views respectively of a dual inductor device with a middle insulating base material 70, plated micro-vias 71, embedded ferromagnetic rod core 72, bottom layer signal traces 73, top layer signal traces 74, top insulating base material 75, bottom insulating base material 76, and three I/O pads 77. The middle I/O pad 77 converts the single unit into a center-tapped or dual inductor device.

Figure 25:
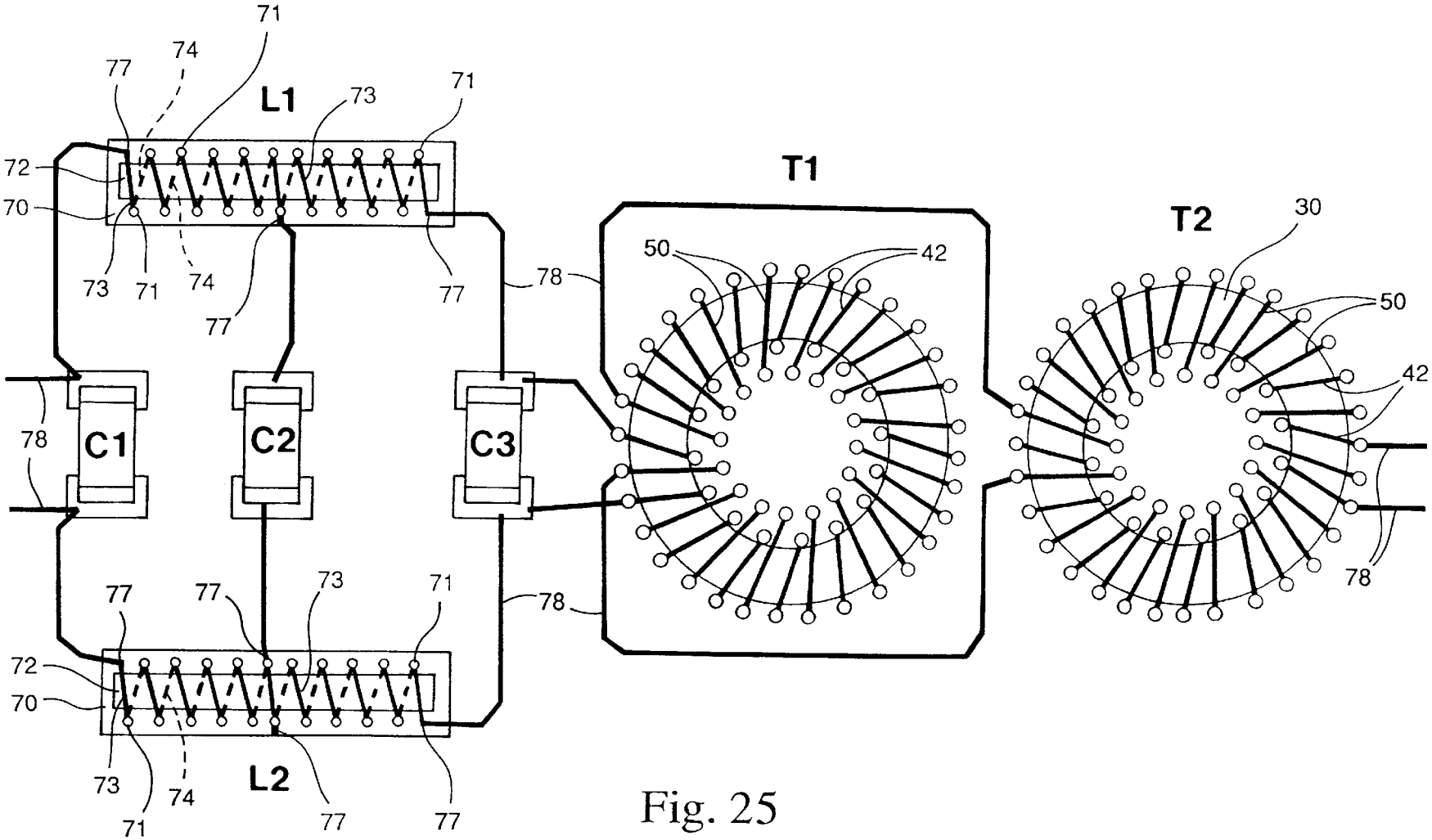
FIG. 25 is a schematic top view of an integrated embedded ferromagnetic filter component of the type commonly found in a local area network communications interface card, fabricated in accordance with the invention.

FIG. 25 shows a top schematic view of an integrated embedded ferromagnetic filter device which includes two inductors L1 and L2, three chip capacitors C1, C2, and C3, a transformer T1, a common-mode choke T2, and signal traces 78. Transformer T1 and choke T2 show embedded toroidal cores 30 with two of the four topside signal traces 42 and 50. Dual inductors L1 and L2 show the same items 70 through 77 described in FIG. 23. This embodiment demonstrates that the invention is suitable for the fabrication of many of the same single components in one set of PWBs, and a plurality of different components in one set of PWBs, with some of the components, same or different, interconnected by signal traces on the inner or outer boards to form an integrated circuit of electrical components. The integrated circuit of FIG. 25 could be used as part of a filter module in a communication circuit such as that described in the IEEE 802.3 Ethernet standard.

It will be appreciated that other electrode and connector arrangements are also possible. Also, types of inductive components other than a tapped transformer can also be made. Also, while each winding would typically comprise many turns in the preferred embodiments, windings of only one turn are also possible. Hence, as used herein, a set of turns can include 1 or more turns.

While not essential, it is preferred that the vias forming part of a single winding are uniformly spaced, easily accomplished with laser drilling, as the resultant winding has more regular turns and thus more uniform electrical properties. With the preferred core geometry, which is annular, usually toroidal shaped, the vias must go through the core holes at the center. The fiber filled epoxy, ground pulp or pre-preg stuffed into the core holes or cavities and around its periphery is insulating and prevents short-circuiting of the vias so long as they are spaced apart.

To make a simple inductor with one winding, only a two-sided layered structure is needed, containing the traces which together with each set of two vias forms the coil winding. For a typical transformer, a 4 layer PWB structure is typically required with the center laminate for the core, the two adjacent inner layers for one winding, and the two outer layers for the second winding.

The typical dimensions of a tapped transformer would be 260×300 mils and 65 mils thick. These dimensions are not critical. It will also be appreciated that more than one component can be incorporated in each unit severed from the large panel.

In an integrated module, many toroidal cores and rods can be arranged in a manner to suit the application. Additionally, other components can be attached to the embedded ferromagnetic device with SMT and TMT, and/or thick-film components in a subsequent process.

The lamination conditions described are not critical, and other temperatures and times can be substituted, especially if different board materials are used. Appropriate lamination conditions are available from the board suppliers.

The process lends itself well to mass production using individual and well-known established techniques including preparation of the B-stage and C-stage boards, laser drilling of the holes, plating of the vias, plating of the board's surfaces, lamination of the individual boards to form the inner and outer panels, with the ferrite cores available in that form directly from suppliers. Also, the provision of the pin or bump terminals for PCBs is well known in the art.

In the preferred embodiments described, the ferrite core or cores are embedded in an insulating carrier. However, the embedding of the cores can also be carried out in the reverse manner, namely, by placing the core or cores in a mold, and molding an insulating carrier of a suitable plastic around each of the cores so that the finished molded product has the cores embedded in an insulating carrier. Additional layers with conductive coatings can then be laminated to both sides of the molded carrier to provide the traces to form the windings for the cores.

While the invention has been described in conjunction with specific embodiments, it will be evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A method of fabricating a ferromagnetic device, comprising the steps:

(a) providing a ferromagnetic core comprising an annular body having an outer periphery and an inner periphery surrounding a hole and embedding the core in a carrier having a non-magnetic insulating layer and providing inside the core hole a non-magnetic insulating material, (b) providing on opposite surfaces of the insulating layer first and second conductive layers, respectively, (c) forming conductive through-holes extending through said carrier outside of the annular body and through the insulating material inside the hole of the annular body and connected to the first and second conductive layers, (d) patterning the first and second conductive layers to form, together with some of the conductive through-holes, at least one set of interconnected conductive turns encircling the ferromagnetic core body to form at least a first coil of said ferromagnetic device.

2. The method of claim 1, further comprising the step of patterning the first and second conductive layers to form, together with others of the conductive through-holes, at least another set of interconnected conductive turns encircling the ferromagnetic core body to form at least a second coil magnetically coupled by the ferromagnetic core to the first coil.

3. A method of fabricating electronic components for use as transformers, chokes or inductors, comprising the steps:

(a) embedding a plurality of spaced discrete annular ferromagnetic cores having holes in a non-magnetic insulating layer with the holes filled with non-magnetic insulating material, (b) laminating to opposite surfaces of the insulating layer first and second conductive layers, respectively, (c) forming conductive through-holes extending through said insulating layer outside of each of the annular cores and through the insulating material inside the holes of each of the annular cores and connected to the first and second conductive layers, (d) thereafter patterning the first and second conductive layers to form, together with some of the conductive through-holes, at least one set of interconnected conductive turns encircling each ferromagnetic core to form at least a first coil of an electronic component.

4. The method of claim 3, wherein a plurality of spaced cavities are provided in the carrier, and placing in each of the cavities a discrete ferromagnetic core.

5. The method of claim 3, wherein the cavities are blind holes.

6. The method of claim 3, further comprising:

(f) providing on opposite sides of the carrier second and third insulating layers each covered with third and fourth outer conductive layers, respectively, (g) forming conductive through-holes on opposite sides of the ferromagnetic core and connected to the third and fourth conductive layers, (h) patterning the third and fourth conductive layers to form together with the through-holes of step (g) at least a second set of conductive turns encircling some of the ferromagnetic cores.

7. The method of claim 3, further comprising severing from the carrier one or more electronic components each comprising a ferromagnetic core or cores encircled by at least one coil and providing at least 1 set of contact pads connected thereto.

8. The method of claim 1, further comprising step (d) being carried out after steps (a)–(c).

9. A method of fabricating an electronic component for use as an inductor, transformer or choke, comprising the steps:

(a) providing a carrier having a middle non-magnetic insulating layer laminated on opposite surfaces with at least first and second conductive layers, respectively, (b) providing at least one cavity in the carrier, (c) inserting in the cavity an annular core of ferromagnetic material having a center hole and filling the hole with non-magnetic insulating material, (d) forming conductive through-holes extending through said carrier outside of the annular core and through the insulating material inside the hole of the annular core and connected to the first and second conductive layers, (e) thereafter patterning the first and second conductive layers to form, together with some of the conductive through-holes, at least one set of interconnected conductive turns encircling the ferromagnetic core to form at least a first coil of said electronic component, (f) thereafter laminating to opposite sides of the carrier second and third insulating layers each covered with third and fourth outer conductive layers, respectively, (g) thereafter forming conductive through-holes outside of the annular core and through the insulating material inside the hole of the annular core and connected to the third and fourth conductive layers, (h) thereafter patterning the third and fourth conductive layers to form together with the through-holes of step (g) at least a second set of conductive turns encircling some of the ferromagnetic cores.

10. A method of fabricating a ferromagnetic device containing a toroidal magnetic core, comprising the steps:

(a) providing a discrete magnetic core in a cavity in a first insulating layer, said magnetic core having an annular body having an outer periphery and an inner periphery surrounding a hole, (b) providing under a bottom surface of the first insulating layer a first conductive layer and patterning the first conductive layer to form first portions of coil turns, (c) providing an insulating material in the core hole, (d) forming outer conductive through-holes extending through said first insulating layer and outside of the outer periphery of the annular body and forming inner conductive through-holes extending through the insulating material in the hole inside of the inner periphery of the annular body, (e) providing over the top surface of the insulating layer a second conductive layer and patterning the second conductive layer to form second portions of the same coil turns, (f) the steps (b), (d), and (e) being carried out in such manner as to connect the first portions of the conductive turns to the second portions of the conductive turns via the inner and outer conductive through-holes to form at least one set of completed interconnected conductive turns encircling the annular body of the magnetic core to form at least a first coil of said ferromagnetic device.

* * * * *